US006139212A

United States Patent [19]

Heiple

[11] Patent Number: 6,139,212

[45] Date of Patent: Oct. 31, 2000

[54] COUPLER FOR EXCAVATING MACHINES AND THE LIKE HAVING FIXED AND MOVEABLE JAWS

[75] Inventor: Ashley Heiple, Alum Bank, Pa.

[73] Assignee: Rockland Manufacturing Co., Bedford, Pa.

[21] Appl. No.: 09/022,113

[22] Filed: Feb. 11, 1998

[51] Int. Cl.[7] ..... E02F 3/28

[52] U.S. Cl. ..... 403/322.1; 403/322.3; 403/31; 37/398

[58] Field of Search ..... 37/398, 399, 440, 37/443, 444, 903; 403/31, 321, 322.1, 322.3, 374.1

[56] References Cited

U.S. PATENT DOCUMENTS

| | | | |
|---|---|---|---|
| 2,016,032 | 10/1935 | Burke | 37/444 |
| 3,208,611 | 9/1965 | Robnett | 414/711 X |
| 3,864,793 | 2/1975 | Guest | 24/569 X |
| 3,880,243 | 4/1975 | Gurries et al. | 172/784 X |
| 4,035,936 | 7/1977 | Avara | 37/396 X |
| 4,187,050 | 2/1980 | Barbee | 414/723 X |
| 4,810,162 | 3/1989 | Foster | 414/723 X |
| 4,881,867 | 11/1989 | Essex et al. | 414/723 X |
| 5,082,389 | 1/1992 | Balemi | 403/322 X |
| 5,147,173 | 9/1992 | Fauber et al. | 414/723 X |
| 5,179,794 | 1/1993 | Ballinger | 37/117.5 X |
| 5,237,762 | 8/1993 | Sandberg | 37/468 X |
| 5,382,110 | 1/1995 | Perotto et al. | 403/322 X |
| 5,423,625 | 6/1995 | Gebauer et al. | 403/322 X |
| 5,487,230 | 1/1996 | Weyer | 37/468 X |
| 5,505,556 | 4/1996 | Brown et al. | 403/322 X |
| 5,592,762 | 1/1997 | Hendron et al. | 37/443 |
| 5,611,158 | 3/1997 | Pratt et al. | 37/468 X |
| 5,625,967 | 5/1997 | Kulle | 37/443 |
| 5,634,735 | 6/1997 | Horton et al. | 403/322 X |
| 5,649,377 | 7/1997 | Tanada | 37/406 X |
| 5,813,792 | 9/1998 | Edwards | 403/322.1 |

*Primary Examiner*—Lynne H. Browne
*Assistant Examiner*—John R. Cottingham
*Attorney, Agent, or Firm*—Lalos & Keegan; Michael N. Lau

[57] ABSTRACT

A coupler for coupling an implement having a pair of spaced connecting pins to a handle and a pivot link of a ground-working machine.

21 Claims, 3 Drawing Sheets

COUPLER FOR EXCAVATING MACHINES AND THE LIKE HAVING FIXED AND MOVEABLE JAWS

This invention relates to an improved coupler and more particularly to a coupler connectable to the dipper stick or handle of a groundworking machine, which may be detachably connected to an implement provided with a pair of spaced connecting pins, for pivotally connecting the implement to the handle of the machine.

BACKGROUND OF THE INVENTION

Groundworking machines used in the construction and other industries typically are provided with a dipper stick or handle pivotally connected to a boom, an implement pivotally connected to a free end of the dipper stick, a support link pivotally connected to the dipper stick, a link pivotally connected at the ends thereof to the support link and the implement and a hydraulic cylinder assembly operatively interconnecting the dipper stick and pivotal connection between the support and pivot links, which may be operated to pivot the implement relative to the dipper stick. Such implements generally are connected to the dipper stick and pivot link by means of a pair of connecting pins having the ends thereof supported on a pair of rigid brackets formed on an upper wall of the implement.

Often, a single, dedicated implement may be connected to a machine. In some operations, however, where a multitude of work functions may be required, necessitating the use of a number of different implements, such as a number of different excavating buckets perhaps having different widths, contours or cutting edges, and where flexibility and expediency may be required, it has been a common practice to utilize a coupler adapted to detachably connect a variety of different implements to the machine.

In the prior art, there has been developed a substantial number of such couplers. Such couplers, however, have been found not to be entirely satisfactory in providing a device that is simple in design, comparatively easy to manufacture, simple and expedient to attach, operate and detach and safe and reliable in performance. It thus is the general object of this invention to provide an improved coupler for detachably connecting a variety of different implements to the dipper stick of a groundworking machine having the aforementioned attributes.

SUMMARY OF THE INVENTION

The present invention generally provides for a coupler for coupling an implement having a pair of spaced connecting pins to the dipper stick or handle and pivot link of a groundworking machine generally consisting of a base member, means mounted on the upper side of the base plate member for pivotally connecting the coupler to the handle and also the pivot link of the machine, at least one fixed jaw member rigidly secured to the underside of the base plate member, having a recess opening in a first direction which may be caused to receive one of the connecting pins of the implement upon maneuvering the handle and pivot link of the machine, and at least one movable jaw member pivotally connected to the underside of the base plate member, having a recess, movable between a locked position wherein the other of the connecting pins of the implement may be caused to be received in the recess thereof and the recess therein opens in a direction aligned with and opposite to the first direction, coupling the implement to the handle, and an unlocked position wherein the other connecting pin is not received in the recess thereof. The recess of the movable jaw member is provided with a surface engageable with the other connecting pin and operable to cam the movable jaw member from the unlocked position to the locked position when the one connecting pin is received within the recess of the fixed jaw member, the movable jaw member is disposed in the unlocked position and the pivot link of the machine is extended to cause the base plate member to pivot about the axis of the one connecting pin disposed in the recess of the fixed jaw member, toward the other connecting pin. Means further is disposed on the underside of the base plate member and operatively engageable with the movable jaw member when in the locked position for restraining the movable jaw member in the locked position.

DESCRIPTION OF THE PREFERRED EMBODIMENT

Figure 2:
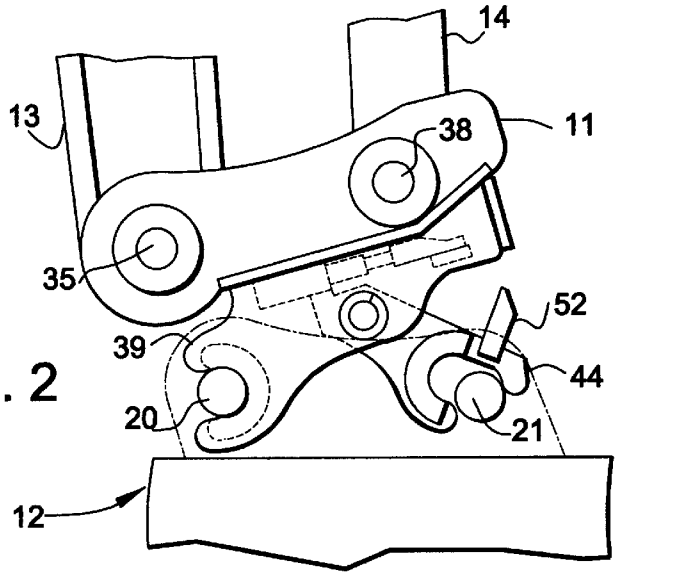
FIG. 2 is a view similar to the view shown in FIG. 1, illustrating the embodiment disposed in a sequential position in coupling the implement to the dipper stick and pivot link of the machine.

Referring to the drawings, there is illustrated a portion of a front end assembly 10 of an excavating machine, a coupler 11 connected to such front end assembly and a bucket 12 detachably connectable to the front end assembly by means of coupler 11. Although not fully shown, the front end assembly of the machine is of a conventional construction including a boom pivotally connected to a platform of the machine, a hydraulic cylinder assembly operatively interconnecting the platform of the machine and the boom for pivoting the boom relative to the platform of the machine about a horizontal axis, a dipper stick or handle 13 pivotally connected to the boom, a hydraulic cylinder assembly operatively interconnecting the boom and the dipper stick for pivoting the dipper stick relative to the boom, a support link pivotally connected to the dipper stick, a pivot link 14 pivotally connected to the support link and a hydraulic cylinder assembly operatively interconnecting the dipper stick and the pivotal connection of the support and pivot links. Bucket 12 also is of a conventional construction having a pair of side walls 15,15, a rear wall 16 curving downwardly and forwardly to merge with a bottom wall 17 and an upper wall 18 cooperating with the side and bottom walls to provide an opening for scooping earth or other materials. Rigidly secured on upper wall 18 is a pair of laterally spaced, longitudinally disposed brackets 19,19 supporting a pair of transversely disposed, longitudinally spaced connecting pins 20 and 21.

Figure 3:
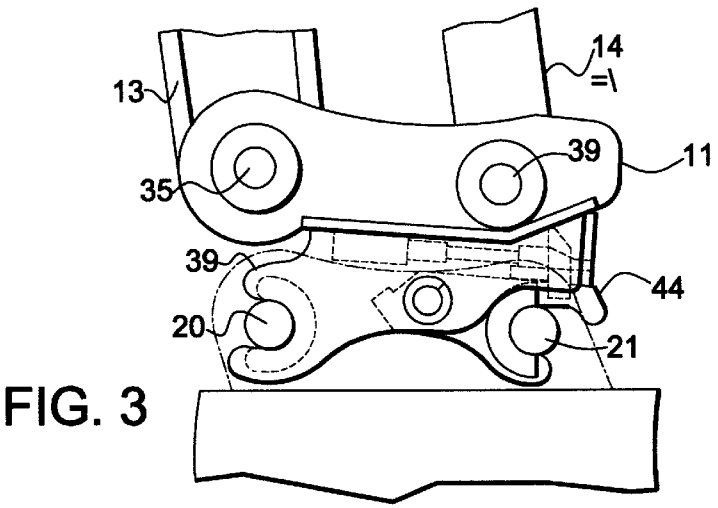
FIG. 3 is a view similar to the views shown in FIGS. 1 and 2, illustrating the embodiment in a still further position in the sequence of positions, operatively attached to the implement.
Figure 1:
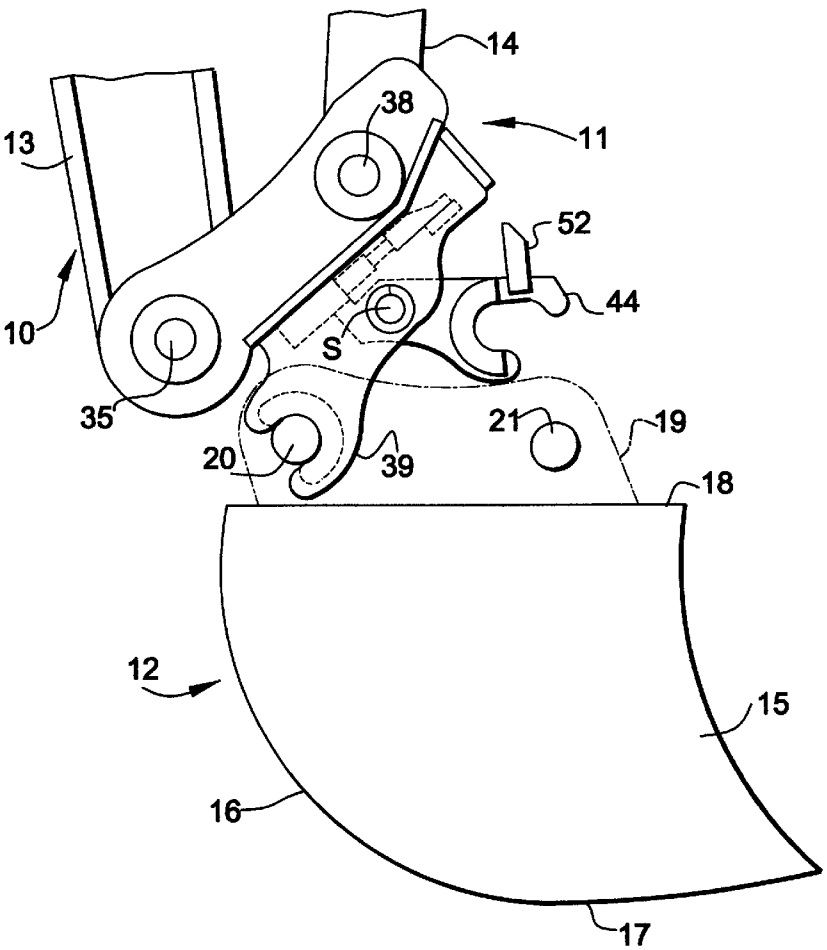
FIG. 1 is a side elevational view of an embodiment of the invention shown connected to the dipper stick or handle and pivot link of a machine, and disposed in a first of a sequence of positions in attaching the embodiment to an implement to be coupled to the machine, having the machine, its boom and a greater portion of the dipper stick and pivot link broken away.
Figure 4:
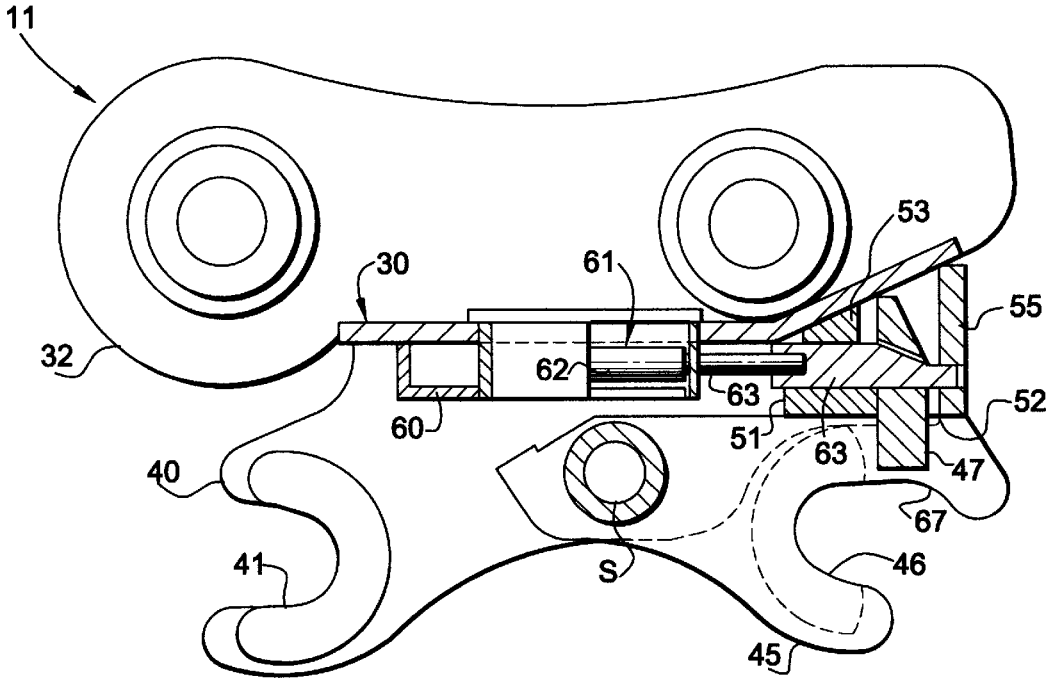
FIG. 4 is an enlarged, vertical cross-sectional view of the embodiment of the invention shown in FIGS. 1 through 3, in the condition as shown in FIG. 3.
Figure 5:
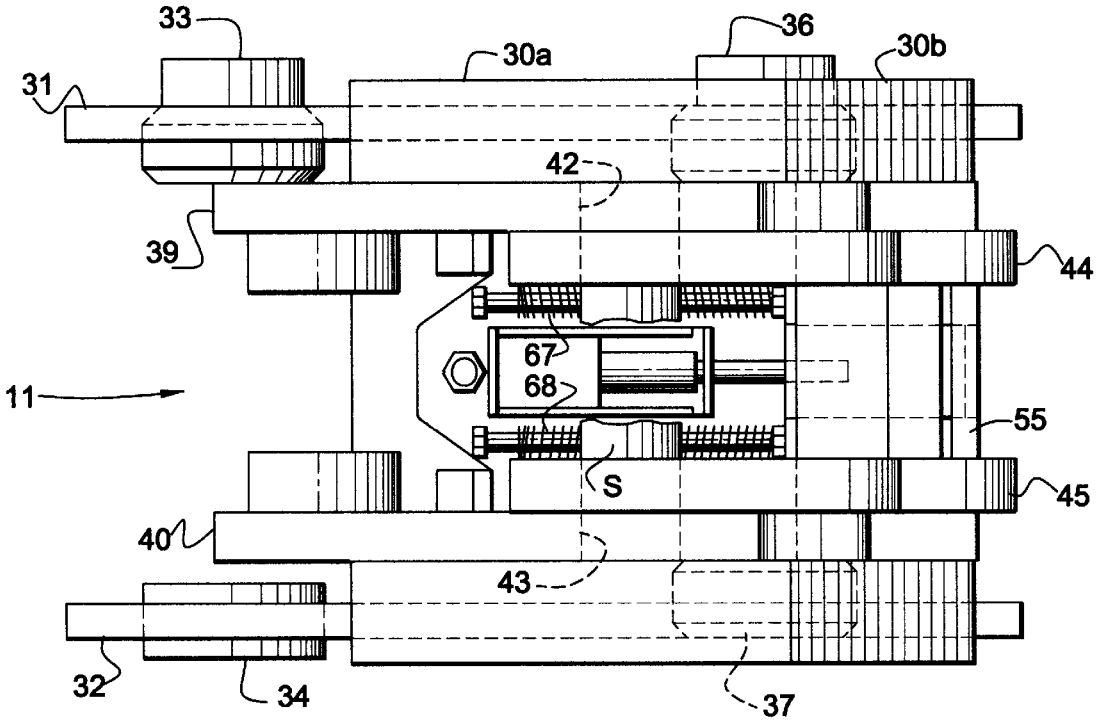
FIG. 5 is an enlarged, bottom view of the embodiment shown in FIG. 3.

As best seen in FIGS. 4 and 5, coupler 11 is provided with a base plate member 30 including a main, rectangularly configured section 30*a* and a forwardly disposed, rectangularly configured section 30*b* offset upwardly at an angle relative to section 30*a*. Rigidly mounted on the upper side of the base plate member is a pair of transversely spaced, longitudinally disposed mounting brackets 31 and 32 having a first set of transversely aligned openings 33 and 34 adapted to receive a connecting pin 35 for securing one end of the coupler to the lower end of dipper stick 13 as shown in FIGS. 1 through 3, and a set of transversely aligned openings 36 and 37 for receiving a connecting pin 38 for detachably securing the front end of the coupler to pivot link 14. Rigidly mounted on the underside of the base plate member is a pair of depending, laterally spaced and horizontally disposed fixed jaw members 39 and 40 having a pair of rearwardly opening recesses 41,41 adapted to receive connecting pin 20 of bucket 12 in the manner as shown in FIGS. 1 through 3. The fixed jaw members further are provided with a pair of transversely aligned openings 42 and 43 in which there is journaled a pivot shaft S. Rigidly secured to pivot shafts is a pair of transversely spaced, longitudinally disposed movable jaw members 44 and 45 pivotal about the axis of pivot shaft, between an open position as shown in FIG. 1 and a closed position as shown in FIGS. 3 through 5, having a pair of outwardly opening recesses 46,46 opening in a direction opposite the direction of opening of recesses 41,41 when the movable jaw members are in the closed position as shown in FIG. 4, and adapted to receive connecting pin 21 of the bucket when in the closed position. Interconnecting the front ends of the movable jaw members, above recesses 46,46 is an upwardly extending lug 47 having a relieved, sloping surface 48 on an outer side thereof, and an opening 49 therein provided with an upper inclined surface 50.

Figure 6:
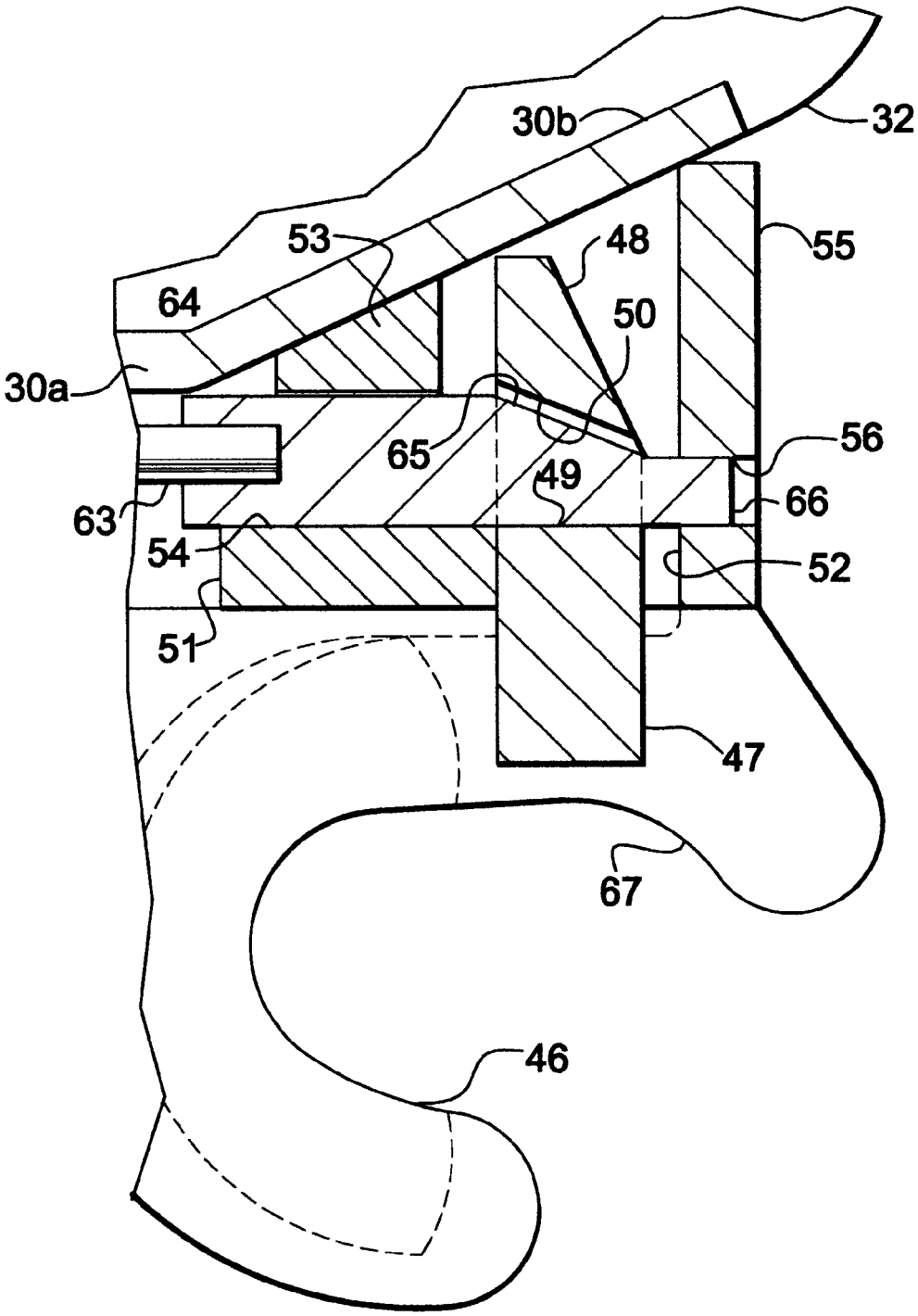
FIG. 6 is an enlarged, partial view of the movable jaw member of the embodiment shown in FIGS. 1 through 5, illustrating the member in the closed position.

Interconnecting and rigidly secured to the inner sides of the front end portions of fixed jaw members 39 and 40 is a transversely disposed plate member 51. Such plate member is spaced below base plate section 30*b* and disposed substantially parallel to base plate section 30*a*. It is provided with an opening 52 which is adapted to receive lug 47 when the movable jaw members are disposed in the closed position as shown in FIG. 4. Spaced above plate member 51, rearwardly of opening 52, is a strip member 53 rigidly secured to the underside of base plate section 30*b* which cooperates with plate member 51 to provide a longitudinally disposed guide slot 54. Also depending from a front end of base plate section 30*b* and rigidly secured thereto and to the inner sides of the front portions of the fixed jaw members is a front plate member 55 having a longitudinally extending slot 56 which is longitudinally aligned with slot 54. As best seen in FIG. 6, when the movable jaw members are in the closed position, opening 49 in lug 47 will register with and be in longitudinal alignment with guide slot 54 and slot 56.

Depending from base plate section 30*a*, between movable jaw members 44 and 45 is a housing 60 in which there is mounted a hydraulic cylinder assembly 61. The assembly includes a cylinder member 62 rigidly mounted within the housing and a rod member 63. Rigidly mounted on the free end of the rod member is a wedge member 64 which is guided in slot 54. When the movable jaw members are in the closed position and rod member 63 is extended as shown in FIGS. 4 through 6, wedge member 64 is adapted to extend through opening 49 in lug 47 and into opening 56 to lock the movable jaw members in the closed position. In such position, an intermediate portion of the wedge member will be received in slot 49 with inclined portion 65 thereof engaging surface 50 of opening 49, and an end portion 66 will be received in opening 56. When rod member 63 is fully retracted, end portion 66 of the wedge member will be retracted to a position within guide slot 54, freeing lug member 47 and thus permitting the movable jaw members to swing to their open position as shown in FIGS. 1 and 2.

The coupler as described is intended to operate in a manner whereby upon applying fluid under pressure to the base end of cylinder member 61, the wedge member will be fully extended through the opening in lug 52 to secure the coupler in the locked position. To prevent the accidental unlocking of the coupler as a result of a loss of pressure at the base end of the cylinder member, there is provided a pair of springs 67 and 68 disposed between the base plate member and wedge member 64 for urging the wedge member in the extended, locking position.

Coupler 11 may be utilized to detachably secure bucket 12 or any other type of implement provided with a pair of connecting pins comparable to connecting pins 20 and 21, to the front end assembly of a machine as described. The implement to be attached may consist of a bucket as shown in the drawings or any other kind of groundworking or material handling implement such as a rake, grapple and the like. Normally, the coupler is in the closed or locking position as shown in FIG. 4 with the movable jaw members in the closed position, rod member 63 extended to extend wedge member 64 through aligned openings 54, 49 and 56 for retaining the movable jaw members in the closed position and springs 67 and 68 exerting a force on the wedge member to bias it in the extended position for assuring the retention of the movable jaw members in the closed position in the event of a failure of the hydraulic system operating cylinder assembly 61.

Whenever the machine operator is desirous of connecting the coupler member to an implement such as excavator 12, he initially operates appropriate controls at the operator's station to actuate cylinder assembly 61 and thus retract rod member 63 and correspondingly wedge member 64, to free the movable jaw members and allow them to swing downwardly about the axis of shaft S to an open position as shown in FIG. 1. Further controls for the cylinder assemblies of the boom and dipper stick are then operated to retract the cylinder assembly connected to the pivot link causing the coupler to pivot relative to the dipper stick to the position shown in FIG. 1. Further controls for the cylinder assemblies of the boom and dipper stick are then operated to position the coupler so that connecting pin 20 is received within recesses 41,41 of fixed jaw members 39 and 40. With the fixed jaw members thus positioned relative to connecting pin 20, the cylinder assembly connected to pivot link 14 is extended, causing the coupler member to pivot about the axis of connecting pin 20, and connecting pin 21 to be received within recesses 46,46 of movable jaw members 44 and 45. As the coupler thus pivots about the axis of connecting pin 20, connecting pin 21 will engage surface segments 67,67 of the movable jaw members to cam them upwardly from the open position shown in FIG. 2 to the closed position as shown in FIGS. 3 and 4.

As the movable jaw members pivot into the closed position, connecting pins 20 and 21 will be received within recesses 41 and 46 of the coupler to firmly secure the implement to the coupler member, and lug 47 will be received between plate members 51 and 55 with the opening 49 therein registered with slots 54 and 56. The controls for cylinder assembly 61 are then operated to extend rod member 63 and, correspondingly, wedge member 64 so that the wedge member will be inserted through slot 49 of the lug member to lock the movable jaw members in the closed position. Springs 167 and 168 further function to bias the wedge member in the extended position to assure locking of the movable jaw members in the closed position. Whenever it is desired to detach the implement, the procedure as described essentially is reversed. Under such conditions, the movable jaw members rotate downwardly under the force of their own weight to an open position to facilitate the attachment of the coupler to another implement as desired.

The construction of the coupler member as described not only facilitates the expedient attachment and detachment of a variety of different implements to the front end assembly of an excavating machine and the like but further provides a reliable connection of the implement to the front end assembly of the machine, capable of transmitting normal loads incurred in working the implement. Furthermore, the springs employed to bias the wedge member of the coupler in the extended position further assures the attachment of the implement to the front end assembly of the machine in the event of a failure of the system operating the cylinder assembly for extending and retracting the wedge member.

It is contemplated that the coupler member as described be of a cast construction formed of carbon steel. The member, however, also may be fabricated from plate steel welded together.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A coupler for detachably securing an implement having a pair of spaced connecting pins to the handle and pivot link of a groundworking or material handling machine comprising:

a base plate member;

first means mounted on an upper side of said base plate member for pivotally connecting said base plate member to said handle;

second means mounted on the upper side of said base plate member for pivotally connecting said base plate member to said pivot link;

at least one fixed jaw member rigidly secured to an underside of said base plate member, having a recess opening in a first direction which may be positioned to receive one of said connecting pins of said implement upon maneuvering said handle of said machine;

at least one movable jaw member pivotally supported on the underside of said base plate member, having a recess, movable between a closed position wherein the other of said connecting pins of said implement is caused to be received in the recess thereof and said recess opens in a direction aligned with and opposite to said first direction, for attaching said implement to said handle, and an open position wherein the other connecting pin is not caused to be received in the recess thereof, said recess of said movable jaw member having a surface engageable with said other connecting pin and operable to cam said movable jaw member from said open position to said closed position when said one connecting pin is received within the recess of said fixed jaw member, said movable jaw member is disposed in the open position and said pivot link is extended to cause said base plate member to pivot about the axis of said one connecting pin disposed in said recess of said fixed jaw member, toward said other connecting pin and;

retaining means disposed on the underside of said base plate member and operatively engageable with said movable jaw member when in said closed position for retaining said movable jaw member in said closed position;

wherein said retaining means includes a member selectively extendible into a pivotal swing path of said movable jaw member when said movable jaw member is in the closed position, precluding its pivotal movement out of the closed position.

2. A coupler according to claim 1 wherein said means for pivotally connecting said base plate member to said handle and said pivot link comprises a set of connecting pins.

3. A coupler according to claim 1 wherein said means for pivotally connecting said base plate member to said handle and pivot link includes a pair of laterally spaced, longitudinally disposed bracket members having two sets of aligned openings for receiving a set of connecting pins therein.

4. A coupler according to claim 1 including a pair of laterally spaced, fixed jaw members having transversely aligned, connecting pin receiving recesses.

5. A coupler according to claim 1 wherein said movable jaw member is pivotally connected to said fixed jaw member.

6. A coupler according to claim 4 including a pair of laterally spaced movable jaw members having transversely aligned, connecting pin receiving recesses.

7. A coupler according to claim 6 wherein said movable jaw members are disposed laterally inwardly relative to said fixed jaw members and are pivotally connected thereto.

8. A coupler according to claim 1 including means for biasing said selectively extendible member in the extended position.

9. A coupler according to claim 8 wherein said biasing means comprises at least one spring anchored on said base plate member and operatively connected to said selectively extendible member.

10. A coupler according to claim 1 wherein said retaining means includes a fluid actuated cylinder assembly, and said selectively extendible member is mounted on a rod member thereof.

11. A coupler according to claim 10 including means for biasing said selectively extendible member in the extended position.

12. A coupler according to claim 11 wherein said biasing means comprises at least one spring anchored on said base plate member and operatively connected to said selectively extendible member.

13. A coupler according to claim 1 wherein said retaining means includes a fluid actuated cylinder assembly provided with an extendible rod member having a wedge member disposed on the end thereof, and said movable jaw member includes an opening registrable with said wedge member when said movable jaw member is in the closed position for receiving said wedge member therein when said rod member is disposed in an extended position.

14. A coupler according to claim 13 including means for biasing said wedge member in the extended position.

15. A coupler according to 14 wherein said biasing means comprises at least one spring anchored on said base plate member and operatively connected to said wedge member.

16. A coupler according to claim 13 including means supported on said base plate member providing at least one bearing surface engageable by said wedge member for restraining said movable jaw member from pivoting out of said closed position when said movable jaw member is in the closed position, said rod member is extended and said wedge member is received in said opening of said movable jaw member.

17. A coupler according to claim 13 wherein said base plate member includes a pair of longitudinally spaced, depending wall members provided with a pair of openings aligned with said rod member for receiving said wedge member therein when said rod member is in an extended position, and said movable jaw member is provided with a lug receivable between said depending wall members, having an opening registrable with said openings in said depending wall members for receiving said wedge member therethrough when said movable jaw member is in the closed position and said rod member is in the extended position.

18. A coupler according to claim 17 including means for biasing said wedge member in an extended position within said registered openings.

19. A coupler according to claim 18 wherein said biasing means comprises a spring anchored on said base plate member and operatively connected to said wedge member.

20. A coupler according to claim 17 wherein said lug opening is provided with a converging cross-sectional configuration and said wedge element also is provided with a converging cross-sectional configuration.

21. A coupler according to claim 17 wherein said depending wall openings provide bearing surfaces of sufficient area engaged by said wedge member for sufficiently transmitting loads between said handle and said implement upon imposing various loads on said implement in the use thereof for performing selected work functions.

* * * * *